US010214698B2

(12) United States Patent
Nelson et al.

(10) Patent No.: US 10,214,698 B2
(45) Date of Patent: Feb. 26, 2019

(54) METHOD OF PROCESSING CRACKED NAPHTHA TO MAKE A LOW-SULFUR NAPHTHA PRODUCT

(71) Applicant: SHELL OIL COMPANY, Houston, TX (US)

(72) Inventors: Richard Gene Nelson, Katy, TX (US); Raymond William Chafin, II, Pearland, TX (US); Richard Carey Green, Amsterdam (NL); Eri Ito, Amsterdam (NL); David William Sacks, Pearland, TX (US); Gerald Max Lawrence, Houston, TX (US)

(73) Assignee: SHELL OIL COMPANY, Houston, TX (US)

( * ) Notice: Subject to any disclaimer, the term of this patent is extended or adjusted under 35 U.S.C. 154(b) by 0 days.

(21) Appl. No.: 15/285,616

(22) Filed: Oct. 5, 2016

(65) Prior Publication Data

US 2017/0101591 A1 Apr. 13, 2017

Related U.S. Application Data

(60) Provisional application No. 62/238,281, filed on Oct. 7, 2015.

(51) Int. Cl.
*C10G 67/00* (2006.01)
*C10G 65/06* (2006.01)
(Continued)

(52) U.S. Cl.
CPC ..... *C10G 67/00* (2013.01); *C10G 7/02* (2013.01); *C10G 65/06* (2013.01); *C10L 1/06* (2013.01); *C10L 1/1616* (2013.01); *C10G 2300/1055* (2013.01); *C10G 2300/202* (2013.01); *C10G 2300/207* (2013.01); *C10G 2300/301* (2013.01); *C10G 2400/02* (2013.01); *C10L 2200/0415* (2013.01); *C10L 2200/0423* (2013.01); *C10L 2270/023* (2013.01); *C10L 2290/24* (2013.01)

(58) Field of Classification Search
CPC ..... C10G 67/00; C10G 2300/202; C10G 2300/207; C10G 2300/301; C10G 2400/02; C10G 2300/1055; C10L 1/1616; C10L 1/06; C10L 2200/0415; C10L 2200/0423; C10L 2290/24; C10L 2270/023
See application file for complete search history.

(56) References Cited

U.S. PATENT DOCUMENTS 4,371,229 A 2/1983 Spangler et al.
5,073,236 A 12/1991 Gelbein et al.
(Continued)

*Primary Examiner* — Randy Boyer
*Assistant Examiner* — Juan C Valencia

(57) ABSTRACT

A method providing for the selective hydroprocessing of cracked naphtha feedstock to make a low-sulfur gasoline blending component. The method includes the use of two catalytic distillation stages in combination with two stripping columns and two fixed-bed reactors integrated in a novel arrangement so as to provide for the treatment of cracked naphtha feedstock that has a high sulfur concentration to yield exceptionally low-sulfur light cracked naphtha and heavy cracked naphtha products. The desulfurized light and heavy cracked naphtha are produced with a minimal amount of hydrogenation of the olefin content and at may suitably be used as gasoline blending components.

12 Claims, 1 Drawing Sheet

(51) Int. Cl.

| | |
|---|---|
| ***C10L 1/06*** | (2006.01) |
| ***C10L 1/16*** | (2006.01) |
| ***C10G 7/02*** | (2006.01) |

(56) References Cited

U.S. PATENT DOCUMENTS

| | | | | |
|---|---|---|---|---|
| 5,266,546 | A | 11/1993 | Hearn | |
| 5,431,890 | A | 7/1995 | Crossland et al. | |
| 6,946,068 | B2 | 9/2005 | Groten | |
| 8,628,656 | B2 | 1/2014 | Podrebarac et al. | |
| 2012/0048778 | A1 * | 3/2012 | Podrebarac ..... | C10G 35/06<br>208/210 |
| 2015/0111726 | A1 | 4/2015 | Bhan et al. | |

* cited by examiner

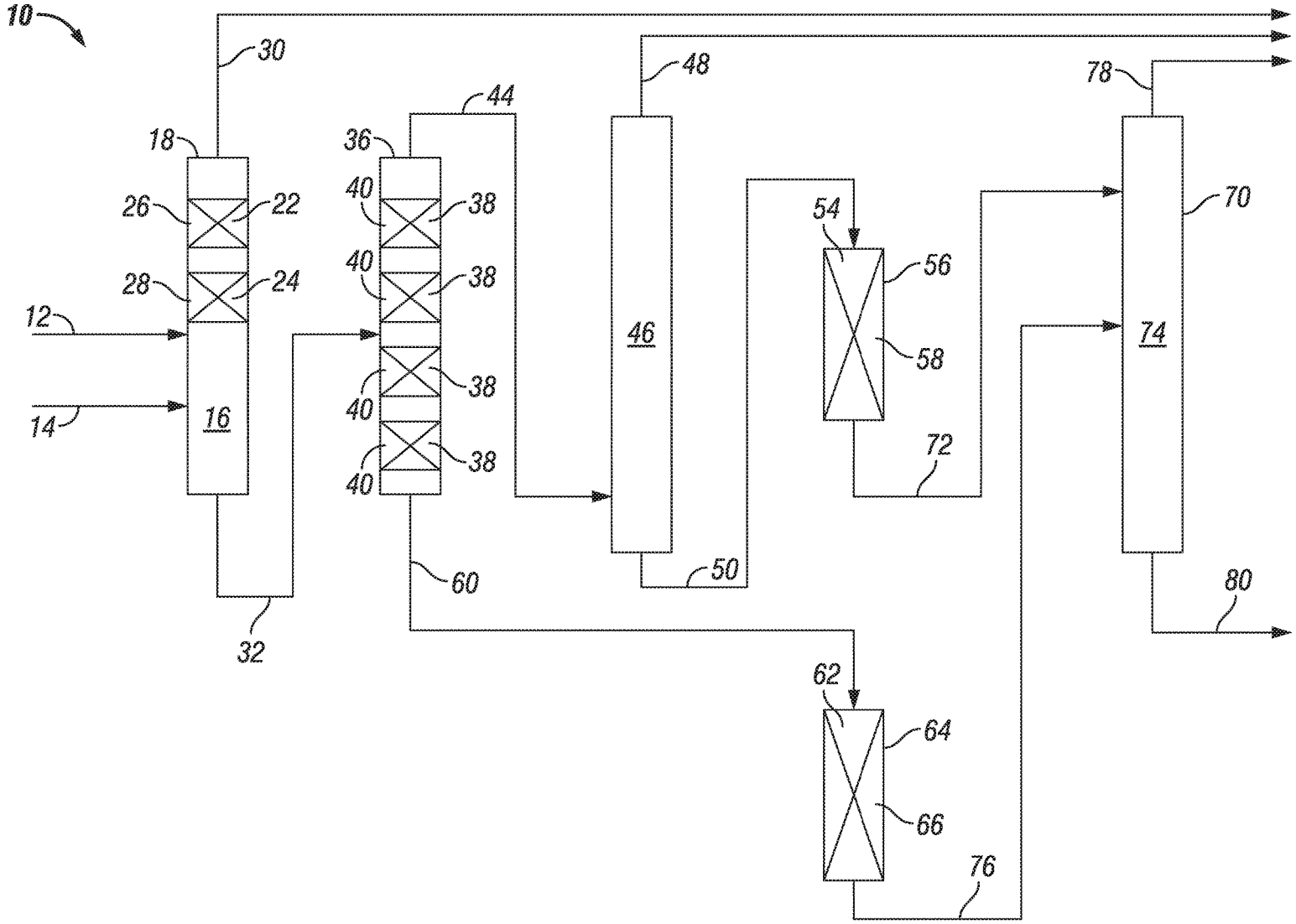
10
12
14
16
18
22
24
26
28
30
32
36
38
40
44
46
48
50
54
56
58
60
62
64
66
70
72
74
76
78
80

METHOD OF PROCESSING CRACKED NAPHTHA TO MAKE A LOW-SULFUR NAPHTHA PRODUCT

The present Non-Provisional Application claims priority from U.S. Provisional Application Ser. No. 62/238,281 filed 7 Oct. 2015, the entire disclosure of which is incorporated herein by reference.

FIELD OF THE INVENTION

This invention relates to a method of processing a cracked feedstock to make a low-sulfur naphtha product that may be used as a blending component of low-sulfur gasoline.

BACKGROUND OF THE INVENTION

Recent governmental regulations have lowered the specification for sulfur concentration in gasoline. A significant source of sulfur in gasoline is from cracked naphtha which is a major refinery blending component of gasoline. In fact, cracked naphtha, in some instances, may account for as much as 75 percent of the total volume of gasoline produced by a given refinery. Typically, the cracked naphtha produced by a refinery accounts for as much as 25 to 50 volume percent of the refinery's total gasoline production.

Cracked naphtha can be either a catalytically cracked or thermally cracked product, and it typically has a high concentration of olefin and aromatic compounds that contribute to its relatively high octane property. The cracked naphtha further may have a high concentration of undesirable organic sulfur compounds, such as, mercaptan, organic sulfide (e.g. thioether), thiophene and heterocyclic sulfur compounds. The concentration of organic sulfur compounds in cracked naphtha may even be as high as up to 2 wt. % (20,000 ppmw), but, typically, it is in the range of from 500 ppmw to 15,000 ppmw. The concentration of desirable olefins contained in cracked naphtha, as noted, is also quite high and can be in the range of from 30 wt. % upwardly to 75 or 80 wt. % of a cracked naphtha stream.

One common method of removing sulfur compounds from hydrocarbon feedstocks is by hydrodesulfurization. This is done by passing the hydrocarbon feedstock over a hydrogenation catalyst in the presence of hydrogen and under suitable hydrodesulfurization reaction conditions so as to hydrogenate the organic sulfur compounds and convert the sulfur to hydrogen sulfide that can easily be removed from the hydrocarbons.

A disadvantage of using hydrodesulfurization to remove organic sulfur from cracked feedstocks, however, is that it also tends to hydrogenate the olefins contained in the cracked feedstock to alkanes. This is not typically desired because olefins generally have higher octane values than alkanes, thus, making it undesirable to saturate the olefins due to the lower economic value of the resulting product as a consequence of the reduced octane value of the treated product.

The prior art discloses various processes that address some of the noted problems associated with the use of hydrodesulfurization to remove organic sulfur from cracked feedstocks. One such process is disclosed in U.S. Pat. No. 6,946,068. This process includes two-stages for the desulfurization of a full-range cracked naphtha feed. The two-stage process uses a first catalytic distillation column followed by a second catalytic distillation column. The first catalytic distillation column contains two reaction zones. The first reaction zone provides for reacting thiophene with hydrogen to produce n-butyl mercaptan and the second reaction zone provides for reacting mercaptans with diolefins to produce sulfides. The first catalytic distillation column further provides for separating the lower boiling and the higher boiling portions of the feed. Because the formed sulfides tend to be higher boiling compounds, they generally pass from the first catalytic distillation column with the higher boiling bottoms product to the second catalytic distillation column. The second catalytic distillation column includes a hydrodesulfurization reaction zone for converting organic sulfur compounds, e.g. sulfides, to hydrogen sulfide by hydrogenation. The second catalytic distillation column further provides for separating the bottoms product taken from the first catalytic distillation column into an intermediate naphtha product and a heavy naphtha product.

Another prior art process for treating cracked feedstocks to remove organic sulfur is detailed in U.S. Pat. No. 8,628,656. This process uses two stages that are similar to and operate in a similar way to those described in U.S. Pat. No. 6,946,068. But, additionally, the process of U.S. Pat. No. 8,628,656 further includes the use of two stripper fractionator columns and an intermediate fixed-bed, single-pass reactor. The stripper fractionator columns provide for the separation of unreacted hydrogen and hydrogen sulfide from naphtha to provide a bottoms fraction from the each stripper. The intermediate fixed-bed, single-pass reactor provides for incremental hydrodesulfurization of the bottoms fraction passing from the first stripper fractionator column with the reactor effluent passing as a feed to the second stripper fractionator column.

U.S. Pat. No. 8,628,656 and U.S. Pat. No. 6,946,068 are both incorporated herein by reference.

While prior art processes are able to provide various levels of selective desulfurization of cracked naphtha streams, due to new, more stringent gasoline sulfur specifications, new or improved processes for treating cracked naphtha are needed in order to reach the lower sulfur concentrations required for gasoline but without significant octane loss caused by undesirable hydrogenation of the high octane olefin compounds of the cracked naphtha.

SUMMARY OF THE INVENTION

Accordingly, provided is a method of processing a cracked feed to make a low-sulfur naphtha product that may suitably be used as a blending component of low-sulfur gasoline. The method comprises passing the cracked feed to a first catalytic distillation column providing for the conversion of mercaptans contained in the cracked feed to sulfides and providing for the selective hydrogenation of diolefins contained in the cracked feed. A light overhead product and a heavy bottoms product are yielded from the first catalytic distillation column. The heavy bottoms product is passed to a second catalytic distillation column that provides for the selective hydrodesulfurization of sulfur compounds contained in the heavy bottoms product. An overhead product containing hydrogen sulfide and a bottoms product containing at least one sulfur compound are yielded from said second catalytic distillation column. The overhead product is passed to a hydrogen sulfide stripper column that provides for the removal of hydrogen sulfide from the overhead product and yielding a stripped bottoms product that is passed to a polishing reactor providing for selective hydrogenation of the at least one sulfur compound to yield a first treated heavy cat naphtha stream. The bottoms product containing the at least one sulfur compound is passed to a bottoms reactor that provides for hydrotreatment of the stripped bottoms product to yield a second treated heavy cat naphtha stream. Both the first treated heavy cat naphtha stream and the second treated heavy cat naphtha stream are passed to a naphtha stabilizer column that provides for removing light hydrocarbons from the first treated heavy cat naphtha stream and the second treated heavy cat naphtha stream to yield a stabilized heavy cat naphtha stream suitable for use as a low-sulfur gasoline blending component.

BRIEF DESCRIPTION OF THE DRAWING

FIG. 1 is a simplified flow diagram of an embodiment of the inventive method of processing a cracked feed to make low-sulfur naphtha.

DETAILED DESCRIPTION OF THE INVENTION

The inventive method provides for the selective hydroprocessing of a cracked feedstock, which comprises hydrocarbons, having boiling temperatures in the naphtha boiling range (C5 to 260° C.) and a large proportion of high octane olefins, and a high concentration of sulfur compounds, so as to yield treated naphtha products having very low concentrations of sulfur compounds. The desulfurization of the cracked feedstock is selective in the sense that it is accomplished with a minimum amount of undesirable olefin hydrogenation or saturation to lower octane paraffins that result in a loss of octane.

The method includes the use of two catalytic distillation stages in combination with two stripping columns and two fixed-bed reactors integrated in a novel arrangement so as to provide for the treatment of the cracked feedstock so as to produce with a minimal amount of olefin hydrogenation exceptionally low-sulfur naphtha products that may suitably be used as gasoline blending components.

Catalytic distillation or reactive distillation, in general, is known in the art. A catalytic distillation column is a system or apparatus that includes a vessel that defines a volume, wherein within the volume is one or more catalytic distillation zones. Each catalytic distillation zone is defined by a catalyst bed or a catalyst structure that is placed within the volume of the catalytic distillation column. The catalytic distillation zone is capable of receiving feed material, such as cracked naphtha having a concentration of sulfur compounds, and it provides means for catalyzing certain desired reactions, such as thioetherification, thiophene hydrogenation, selective diolefin hydrogenation, hydrodesulfurization, etc., while simultaneously or concurrently fractionally separating or distilling the feed material and reaction products within the catalytic distillation zone.

As noted above, the catalytic distillation zone is defined by either a catalyst bed or a catalyst structure that is placed within the volume defined by the vessel of the catalytic distillation column. Typically, the catalyst bed comprises a bed of catalyst particles that usually are in the shape of small diameter extrudates or spheres and often comprise an inorganic oxide support component, e. g. alumina, silica or titania, and a metal catalyst component, e. g. nickel, cobalt, molybdenum, chromium, tungsten or a noble metal such as platinum or palladium. The catalyst particles may be placed or loaded upon a support panel within the vessel to form a bed of catalyst particles that fills the open area within the vessel and has a depth that together provide a volume of catalyst particles.

It is preferred for the catalytic distillation zone to be defined by a catalyst structure. One example of a suitable catalyst structure is described in U.S. Pat. No. 5,730,843, which disclosure is incorporated herein by reference. Another suitable catalyst structure is described in U.S. Pat. No. 5,431,890. This catalyst structure includes catalyst particles contained within a plurality of wire mesh tubes closed at either end and laid across a sheet of wire mesh fabric such as demister wire. The sheet and tubes are then rolled into a bale for loading into the catalytic distillation column. The disclosures of U.S. Pat. No. 5,431,890 are incorporated herein by reference. Other useful catalyst structures are disclosed in U.S. Pat. Nos. 4,371,229, 5,073,236, 5,431,890 and 5,266,546, which are each incorporated herein by reference.

The cracked feed of the inventive method comprises a thermally or catalytically cracked product that is yielded from, for example, a fluidized catalytic cracking or a coker refinery unit. It is preferred for the cracked feed to include hydrocarbons boiling in the temperature range of full range naphtha and heavy gasoline, which generally is in the temperature range of from about 5° C. (41° F.) to about 260° C. (500° F.). The boiling temperature range is as determined by ASTM D86 distillation.

The cracked feed further comprises a concentration of at least one sulfur compound, a concentration of at least one olefin compound, and a concentration of at least one diolefin compound.

When referring herein to sulfur compounds, what is meant is organic sulfur compounds that include mercaptans, organic sulfides (including the reaction product of mercaptans and olefins or diolefins), thiopheneic compounds, and heterocyclic sulfur compounds but excluding hydrogen sulfide and carbonyl sulfide.

The cracked feed has a high concentration of organic sulfur that generally is in the range of from 500 ppmw to 2 wt. % (20,000 ppmw). More typically, the organic sulfur concentration of the cracked feed is in the range of from 750 ppmw to 1.5 wt. % (15,000 ppmw), and, most typically, from 1,000 ppmw to 1.25 wt. % (12,500 ppmw).

The cracked feed further has a high concentration of olefin compounds. The concentration of these olefins in the cracked feed is generally within the range of from about 25 wt. % to about 75 wt. % of the cracked feed. More typically, the olefin concentration is in the range of from 30 wt. % to 70 wt. %, and, most typically, from 35 wt. % to 65 wt. %.

The cracked feed also may have a concentration of diolefin compounds. This concentration is generally within the range upwardly to about 2 wt. %, but, more typically, in the range of from 0.01 wt. % to 1.5 wt. %, and, most typically, from 0.05 wt. % to 1 wt. % of the cracked feed.

The cracked feed of the inventive method is passed and introduced into the first catalytic distillation column of the process. Contained within the volume defined by the first catalytic distillation column are one or more catalytic distillation thioetherification zones or one or more catalytic hydrogenation zones, or a combination of both zones.

The thioetherification catalyst used in defining the thioetherification zone of the first catalytic distillation column may be any catalyst composition that suitably promotes the thioetherification reaction of the mercaptans and diolefins contained in the cracked feed that is charged to the first catalytic distillation column. Typically, the thioetherification catalyst is a Group VIII metal catalyst type that is a composition comprising either nickel or palladium deposited upon an alumina support. Such a suitable catalyst is described in U.S. Pat. No. 8,628,656 and U.S. Pat. No. 6,946,068.

An example of a suitable nickel containing thioetherification catalyst comprises nickel supported on an alumina support, wherein the nickel is present in an amount in the range of from 1 to 10 wt. % of the catalyst weight and the alumina is present in an amount in the range upwardly to 99 wt. % of the catalyst weight. A preferred thioetherification catalyst comprises palladium supported on an alumina support wherein the palladium is present in an amount in the range of from 0.01 wt. % to 2 wt. % of the catalyst weight and the alumina is present in an amount in the range of from 97 wt. % to 99 wt. %.

The first catalytic distillation column may provide means for converting at least a portion of the mercaptan compounds contained in the cracked feed by a thioetherification reaction (i.e., reacting mercaptans with diolefins to form sulfides). The first catalytic distillation column also may provide means for converting at least a portion of the thiophene compounds contained in the cracked feed by a hydrogenation reaction (i.e., reacting it with hydrogen to produce n-butyl mercaptan). Furthermore, the first catalytic distillation column may further provide a combination of both such means for converting mercaptan compounds in a cracked feed and means for converting thiophene compounds in a cracked feed.

The first catalytic distillation column further provides means for concurrently separating or distilling the cracked feed and first catalytic distillation product of the thioetherification reaction or hydrogenation reaction, or both reactions, to yield a light overhead product and a heavy bottoms product.

The first catalytic distillation column and the catalytic distillation zones therein are operated under conditions suitably to provide for the desired thioetherification and hydrogenation reactions. Generally, the operating temperatures are in the range of from 90° C. to 210° C., the total pressure is in the range of from 50 psig to 300 psig, the hydrogen partial pressure is in the range of from 0.1 to 75 psia, the WHSV of the cracked feed is in the range of from 1 to 10, and hydrogen feed rate is in the range of from 10 to 1,000 scf/bbl.

The light overhead product is a light cracked naphtha that comprises hydrocarbons boiling in the temperature range of from 5° C. (41° F.) to 80° C. (176° C.), and, particularly, comprising hydrocarbons having five and six carbon atoms per molecule (i.e., C5 and C6). Also passing overhead from the first catalytic distillation column are the gaseous compounds of hydrogen and hydrogen sulfide. Carbonyl sulfide will also pass overhead if there is any present. The gaseous compounds of hydrogen, hydrogen sulfide and carbonyl sulfide may be separated from the light cracked naphtha to separately pass from the first catalytic distillation column.

The heavy bottoms product is a heavy cracked naphtha that comprises hydrocarbons boiling in the temperature range of from 80° C. (176° C.) to 260° C. (500° F.).

The sulfur compounds of the cracked feed and the sulfide and mercaptan reaction products of the catalytic distillation concentrate in the bottom of the first catalytic distillation column and pass with heavy bottoms product. The heavy bottoms product has an organic sulfur concentration in the range of from 300 ppmw to 15,000 ppmw, but, more typically for the process, the organic sulfur concentration is in the range of from 400 ppmw to 10,000 ppmw, or from 500 ppmw to 5,000 ppmw.

The heavy bottoms product is passed to the second catalytic distillation column and introduced into the one or more hydrodesulfurization zones contained within the volume defined by the second catalytic distillation column. The second catalytic distillation column provides means for simultaneously or concurrently selectively converting at least a portion of the sulfur compounds of the heavy bottoms product to hydrogen sulfide by hydrodesulfurization (i.e., reacting organic sulfur with hydrogen to form hydrogen sulfide and hydrocarbon) and means for fractionally separating or distilling the heavy bottoms product and second catalytic distillation product of the hydrodesulfurization reaction to yield an overhead product and a bottoms product.

When speaking of selectively converting sulfur compounds of the cracked feed, what is meant is that the hydrodesulfurization reaction is accomplished with a minimal amount of hydrogenation of the olefin compounds contained in the heavy bottoms product, or, at least, with the intent to minimize olefin saturation.

The hydrodesulfurization catalyst used in defining the hydrodesulfurization zones of the second catalytic distillation column may be any catalyst composition that suitably promotes the hydrodesulfurization reaction of organic sulfur with hydrogen to form hydrogen sulfide and hydrocarbon. Suitable hydrodesulfurization catalysts comprise either nickel or cobalt preferably in combination with either molybdenum or tungsten on an inorganic oxide, such as, alumina, silica, titania and combinations thereof. The nickel or cobalt metal component of the hydrodesulfurization catalyst is present in an amount in the range of from 1 to 10 wt. % and the molybdenum or tungsten component is present in an amount in the range of from 5 to 20 wt. %. The wt. % is based on the metal being in an oxide form and the total catalyst weight. The hydrodesulfurization catalyst is preferably in the form of an agglomerate such as an extrudate or a sphere. The hydrodesulfurization catalyst may be either an impregnated catalyst or a co-mulled catalyst. Such a suitable catalyst is described in U.S. Pat. No. 8,628,656 and U.S. Pat. No. 6,946,068.

The second catalytic distillation column and the hydrodesulfurization catalytic distillation zones therein are operated under conditions suitably to provide for the desired hydrodesulfurization reactions. Generally, the operating temperatures are in the range of from 150° C. to 425° C., the total pressure is in the range of from 75 psig to 350 psig, the hydrogen partial pressure is in the range of from 6 to 100 psia, the WHSV of the cracked feed is in the range of from 1 to 5, and hydrogen feed rate is in the range of from 10 to 1,000 scf/bbl.

The overhead product from the second catalytic distillation column is a lighter cut of the heavy bottoms product and the second catalytic distillation product, and it further comprises hydrogen sulfide yielded from the hydrodesulfurization reaction and a small amount or concentration of lighter organic sulfur compounds. The overhead product comprises hydrocarbons boiling in the temperature range of from 80° C. (176° C.) to 150° C. (302° F.).

The concentration of sulfur compounds in the overhead product can typically be in the range of from 50 ppmw to 500 ppmw. More typically, the sulfur concentration in the overhead product is in the range of from 75 to 400 ppmw, and, most typically, from 100 to 300 ppmw.

The bottoms product from the second catalytic distillation column is a heavier cut of the heavy bottoms product and the second catalytic distillation product. The bottoms product comprises heavier sulfur compounds that have not been converted by the hydrodesulfurization reaction and that concentrate in the bottoms product of the second catalytic distillation column. The bottoms product, however, is substantially free of hydrogen sulfide. The bottoms product comprises hydrocarbons boiling in the temperature range of from 120° C. (248° C.) to 260° C. (500° F.).

The concentration of sulfur compounds in the bottoms product is typically in the range of from 50 ppmw to 500 ppmw. More typically, the sulfur concentration in the bottoms product is in the range of from 75 to 400 ppmw, and, most typically, from 100 to 300 ppmw.

The overhead product from the second catalytic distillation column is passed and introduced into a conventional hydrogen sulfide stripper column of the type known to those skilled in the art that provides means for stripping hydrogen sulfide from the overhead product and yielding a hydrogen sulfide overhead stream and a stripped bottoms product that is substantially free of hydrogen sulfide but having a concentration of sulfur compounds. The concentration of sulfur compounds in the stripped bottoms product is in the range of from 50 to 500 ppmw. More typically, it is in the range of from 75 to 400 ppmw, and, most typically, from 100 to 300 ppmw.

The stripped bottoms product is then passed and introduced into a polishing reactor that provides means for selectively hydrogenating at least a portion of the sulfur compounds contained in the stripped bottoms product to hydrogen sulfide so as to yield a first treated heavy cat naphtha stream.

The polishing reactor can be any suitable fixed bed reactor system that is generally known to those skilled in the art. The polishing reactor includes a polishing reactor vessel that defines a selective hydrotreating reaction zone containing a polishing reactor catalyst providing for the selective hydrogenation reaction of the sulfur compounds contained in the stripped bottoms product to hydrogen sulfide. The polishing reactor effluent (first treated heavy cat naphtha stream) that passes from the polishing reactor has a reduced sulfur concentration of less than 25 ppmw, preferably less than 15 ppmw, and, most preferably, less than 10 ppmw.

The polishing reactor catalyst may be any catalyst composition that suitably provides for the hydrodesulfurization of the stripped bottoms product charged to the polishing reactor. Suitable catalysts for use in the polishing reactor comprise either nickel or cobalt preferably in combination with either molybdenum or tungsten on an inorganic oxide, such as, alumina, silica, titania and combinations thereof. The nickel or cobalt metal component of the polishing reactor catalyst is present in an amount in the range of from 1 to 10 wt. % and the molybdenum or tungsten component is present in an amount in the range of from 5 to 20 wt. %. The wt. % is based on the metal being in an oxide form and the total catalyst weight. The polishing reactor catalyst is preferably in the form of an agglomerate such as an extrudate or a sphere. The hydrodesulfurization catalyst may be either an impregnated catalyst or a co-mulled catalyst.

The polishing reactor is operated under conditions suitably to provide for the desired hydrodesulfurization of the stripped bottoms product. Generally, the operating temperatures are in the range of from 150° C. to 425° C., the total pressure is in the range of from 75 psig to 350 psig, the hydrogen partial pressure is in the range of from 6 to 100 psia, the WHSV of the cracked feed is in the range of from 1 to 5, and hydrogen feed rate is in the range of from 10 to 1,000 scf/bbl.

The bottoms product is passed and introduced into a bottoms reactor that provides means for hydrotreating the bottoms product to convert at least a portion of the sulfur compounds contained therein to hydrogen sulfide so as to yield a second treated heavy cat naphtha stream.

The bottoms reactor can be any suitable fixed bed reactor system that is generally known to those skilled in the art. The bottoms reactor includes a bottoms reactor vessel that defines a hydrotreatment reaction zone containing a bottoms reactor catalyst providing for the hydrogenation reaction of the sulfur compounds contained in the bottoms product to hydrogen sulfide. The bottoms reactor effluent or second treated heavy cat naphtha stream that passes from the bottoms reactor has a reduced sulfur concentration of less than 25 ppmw, preferably less than 15 ppmw, and, most preferably, less than 10 ppmw.

The bottoms reactor catalyst may be any catalyst composition that suitably provides for the hydrodesulfurization of the bottoms product charged to the bottoms reactor. Suitable catalysts for use in the bottoms reactor comprise either nickel or cobalt preferably in combination with either molybdenum or tungsten on an inorganic oxide, such as, alumina, silica, titania and combinations thereof. The nickel or cobalt metal component of the bottoms reactor catalyst is present in an amount in the range of from 1 to 10 wt. % and the molybdenum or tungsten component is present in an amount in the range of from 5 to 20 wt. %. The wt. % is based on the metal being in an oxide form and the total catalyst weight. The bottoms reactor catalyst is preferably in the form of an agglomerate such as an extrudate or a sphere. The hydrodesulfurization catalyst may be either an impregnated catalyst or a co-mulled catalyst.

A particularly preferred catalyst composition for use in the bottoms reactor is the co-mulled catalyst described in US Patent Application Publication 2015/0111726 of Bhan et al. This patent application publication is incorporated herein by reference. The catalyst comprises a calcined mixture, wherein the mixture comprises an inorganic oxide material, molybdenum trioxide, and a nickel compound, wherein the calcined mixture is further overlaid with a cobalt component and a molybdenum component. This catalyst composition provides for particular benefits not observed of other catalyst compositions. In particular, it appears to be selective.

The bottoms reactor is operated under conditions suitable to provide for the desired hydrodesulfurization of the bottoms product. Generally, the operating temperatures are in the range of from 150° C. to 425° C., the total pressure is in the range of from 75 psig to 350 psig, the hydrogen partial pressure is in the range of from 6 to 200 psia, the WHSV of the cracked feed is in the range of from 1 to 5, and hydrogen feed rate is in the range of from 10 to 2,000 scf/bbl.

Both the polishing reactor effluent and the bottoms reactor effluent are passed and introduced into the naphtha stabilizer column. The naphtha stabilizer column is stripper column of the type known to those skilled in the art that provides means for stripping hydrogen sulfide from the polishing reactor effluent and bottoms reactor effluent charged to the naphtha stabilizer column and yielding a stabilized heavy cat naphtha stream that is substantially free of hydrogen sulfide and having a very low concentration of sulfur. The concentration of sulfur compounds in the stabilized cat naphtha stream is less than 25 ppmw, preferably, less than 15 ppmw, and, most preferably, less than 10 ppmw.

Reference is now made to FIG. 1 which presents a simplified process flow diagram illustrating process 10 which is an embodiment of the inventive method for processing a cracked feedstock to make a low-sulfur naphtha product that may suitably be used as a blending component of low-sulfur gasoline.

In process 10, hydrogen and a cracked feedstock respectively pass by way of lines 12 and 14 and are introduced into volume 16 defined by first catalytic distillation column 18.

Placed within the upper portion of volume 16 of first catalytic distillation column 18 is thioetherification zone 22. Hydrogenation zone 24 is placed within volume 16 at a relative location below thioetherification zone 22.

Thioetherification zone 22 provides means for simultaneously reacting the mercaptans with diolefins of the cracked feedstock to form sulfide compounds and separating by distillation the reaction products and hydrocarbons. Thioetherification zone 22 is defined by either a catalyst bed or a catalyst structure 26. The catalyst bed or catalyst structure 26 is described above and typically includes a Group VIII metal catalyst type.

Hydrogenation zone 24 provides means for simultaneously reacting the thiophenes of the cracked feedstock with hydrogen to form mercaptans and separating by distillation the reaction products and hydrocarbons. Hydrogenation zone 24 is defined by either a catalyst bed or a catalyst structure 28 as described above and typically includes a hydrogenation catalyst type.

First catalytic distillation column 18, which includes thioetherification zone 22 and hydrogenation zone 24, provide means for separating the cracked feedstock into a light overhead product, or a light cracked naphtha, and a heavy bottoms product, or a heavy cracked naphtha. The light cracked naphtha typically primarily comprises C5 and C6 hydrocarbons that generally boil within the temperature range of from 5° C. (41° F.) to 80° C. (176° F.). The heavy cracked naphtha typically comprises C6+ hydrocarbons that generally boil within the temperature range of from 80° C. (122° F.) to 245° C. (473° F.).

The light overhead product passes from first catalytic distillation column 18 by way of line 30. Also, passing overhead from first catalytic distillation column 18 are normally gaseous hydrogen and hydrogen sulfide, and, if present, carbonyl sulfide. These gases can be separated from the light cracked naphtha (light overhead product) to separately pass to downstream from first catalytic distillation column 18. Methods of separation of the two streams are known to those skilled in the art and may include, for example, flash separation (not shown), and yielding of the light cracked naphtha from first catalytic distillation column 18 as a side draw product (not shown).

The heavy bottoms product passes from first catalytic distillation column 18 by way of line 32 and is introduced into volume 34 defined by second catalytic distillation column 36. Placed within volume 34 is at least one hydrodesulfurization zone 38.

The at least one hydrodesulfurization zone 38 provide means for simultaneously or concurrently selectively converting at least a portion of the sulfur compounds of the heavy bottoms product to hydrogen sulfide by hydrodesulfurization (i.e., reacting organic sulfur with hydrogen to form hydrogen sulfide and hydrocarbon) and fractionally separating or distilling of the heavy bottoms product to yield an overhead product and a bottoms product.

Each hydrodesulfurization zone 38 is defined by either a catalyst bed or a catalyst structure 40. The catalyst bed or catalyst structure 40 is described above and typically includes a hydrodesulfurization catalyst type.

The overhead product is a lighter cut of the heavy bottoms product and typically it includes hydrocarbons boiling in the temperature range of from 50° C. to 150° C. The overhead product also contains hydrogen and hydrogen sulfide, and, if present, carbonyl sulfide, along with a concentration of sulfur compounds.

The overhead product passes from second catalytic distillation column 36 through line 44 and is introduced into hydrogen sulfide stripper column 46 which provides for removal of hydrogen sulfide and hydrogen from the overhead product to yield a hydrogen sulfide overhead stream that comprises hydrogen sulfide and hydrogen and a stripped bottoms product. Hydrogen sulfide stripper column 46 may be any suitable equipment or separation system known to those skilled in the art of distillation.

The hydrogen sulfide overhead stream passes from hydrogen sulfide stripper column 46 by way of line 48 to downstream. Although hydrogen sulfide has been removed from the stripped bottoms product, it still has an unacceptable concentration of sulfur compounds that is typically in the range of from 50 ppmw to 500 ppmw. The stripped bottoms product passes from hydrogen sulfide stripper column 46 through line 50 and is introduced into the hydrodesulfurization reaction zone 54 that is defined by polishing reactor 56 and which contains hydrodesulfurization catalyst 58.

Polishing reactor 56 provides means for hydrodesulfurization of the stripped bottoms product to yield a first treated heavy cat naphtha stream having a reduced concentration of sulfur compounds relative to their concentration in the stripped bottoms product. This hydrodesulfurization of the stripped bottoms product includes converting at least a portion of its sulfur compounds to hydrogen sulfide by the hydrogenation of the organic sulfur compounds (mercaptans, organic sulfides, and other organic sulfur compounds). The sulfur concentration of the first treated cat naphtha stream is typically less than 25 ppmw, but, most preferably, it is less than 10 ppmw.

The second catalytic distillation column 36 bottoms product, having a concentration of sulfur compounds that is typically in the range of from 50 ppmw to 500 ppmw, passes from second catalytic distillation column 36 by way of line 60 and is introduced into hydrodesulfurization reaction zone 62 that is defined by bottoms reactor 64 containing hydrodesulfurization catalyst 66.

A bottoms reactor 64 provides means for hydrodesulfurization of the bottoms product to yield a second treated heavy cat naphtha stream having a reduced concentration of sulfur compounds relative to their concentration in the bottoms product. This hydrodesulfurization of the bottoms product includes converting at least a portion of its sulfur compounds to hydrogen sulfide by the hydrogenation of the organic sulfur compounds (mercaptans, organic sulfides, and other organic sulfur compounds). The sulfur concentration of the second treated cat naphtha stream is typically less than 25 ppmw, but, most preferably, it is less than 10 ppmw.

In order to remove the hydrogen sulfide from the first treated heavy cat naphtha stream that is produced as a result of the respective hydrodesulfurization steps provided by polishing reactor 56 the first treated heavy cat naphtha stream is passed and introduced into naphtha stabilizer column 70. The naphtha stabilizer column 70 may be any suitable equipment or separation system known to those skilled in the art of distillation. The first treated heavy cat naphtha stream passes from polishing reactor 56 through line 72 and is introduced into stripping zone 74 that is defined by naphtha stabilizer column 70.

The second treated heavy cat naphtha stream passes from bottoms reactor 64 through line 75 and is introduced into separation zone 76 that is defined by separator vessel 77. Separator vessel 77 provides means for separating hydrogen and vaporous hydrocarbons from the second treated heavy cat naphtha stream to yield by a single stage separation a separator vapor product stream and a separator liquid product stream. The separator vapor product stream passes from separation zone 76 through line 78 and is introduced into the lower portion of volume 34 of second catalytic distillation column 36. The separator liquid product stream passes from separation zone 76 by way of line 79 and is introduced into stripping zone 74 defined by naphtha stabilizer column 70.

Naphtha stabilizer column 70 provides means for removing hydrogen sulfide and light hydrocarbons from the first treated heavy cat naphtha stream and the separator liquid product stream that are introduced into stripping zone 74 of naphtha stabilizer column 70 so as to yield a stabilized heavy cat naphtha stream that is suitable for use as a low-sulfur gasoline blending component. The stripped hydrogen sulfide and light hydrocarbons pass from naphtha stabilizer column 70 via line 78 to downstream, and the stabilized heavy cat naphtha stream passes from naphtha stabilizer column 70 via line 80 to downstream. The stabilized heavy cat naphtha is stripped of hydrogen sulfide and light hydrocarbons and has a low sulfur concentration of less than 25 ppmw, and, most preferably, less than 10 ppmw.

The invention claimed is:

1. A method of processing a cracked feed to make a low-sulfur naphtha product that may suitably be used as a blending component of low-sulfur gasoline, wherein said method comprises:

passing said cracked feed to a first catalytic distillation column that defines a volume having both a thioetherification zone and a hydrogenation zone at a relative location below the thioetherification zone, wherein the thioetherification zone provides for simultaneously reacting mercaptans with diolefins contained in said cracked feed to form sulfides and separating by distillation the reaction products and hydrocarbons, wherein the hydrogenation zone provides for simultaneously reacting thiophenes in said cracked feed with hydrogen to form mercaptans and separating by distillation the reaction products and hydrocarbons, wherein said cracked feed is a full range naphtha comprising hydrocarbons boiling in the range of from C5 (boiling temperature of hydrocarbon molecules having five carbon atoms per molecule) to 260° C. (500° F.), at least one organic sulfur compound, at least one olefin compound, and at least one diolefin compound, and wherein said cracked feed has a total organic sulfur concentration in the range of from about 500 ppm to about 2 wt. % (20,000 ppm), an olefin concentration in the range of from about 30 wt. % to 75 wt. %, a diolefin concentration in the range upwardly to 2 wt. %;

yielding from said first catalytic distillation column a light overhead product and a heavy bottoms product;

passing said heavy bottoms product to a second catalytic distillation column providing for the selective hydrodesulfurization of sulfur compounds contained in said heavy bottoms product;

yielding from said second catalytic distillation column an overhead product containing hydrogen sulfide and a bottoms product containing at least one sulfur compound;

passing said overhead product to a hydrogen sulfide stripper column providing for the removal of hydrogen sulfide from said overhead product and yielding a stripped bottoms product;

passing said stripped bottoms product to a polishing reactor providing for the selective hydrogenation of said at least one sulfur compound to yield a first treated heavy cat naphtha stream;

passing said bottoms product containing said at least one sulfur compound to a bottoms reactor providing for hydrotreatment of said bottoms product to yield a second treated heavy cat naphtha stream; and passing both said first treated heavy cat naphtha stream and said second treated heavy cat naphtha stream to a naphtha stabilizer column providing for removal of light hydrocarbons from said first treated heavy cat naphtha stream and said second treated heavy cat naphtha stream to yield a stabilized heavy cat naphtha stream suitable for use as a low-sulfur gasoline blending component having a sulfur concentration of less than 25 ppmw.

2. A method as recited in claim 1, wherein said first catalytic distillation column for receiving a cracked feed defines a first zone having at least one catalytic distillation thioetherification zone providing for reacting mercaptans with diolefins to form sulfides, wherein each said at least one catalytic distillation thioetherification zone contains a Group VIII metal catalyst type and providing for concurrent distillation separation of a first catalytic distillation product into said light overhead product and said heavy bottoms product.

3. A method as recited in claim 1, wherein said first catalytic distillation column for receiving a cracked feed further defines a second zone having at least one catalytic distillation hydrogenation zone providing for reacting thiophene with hydrogen to form mercaptans, wherein each said at least one catalytic distillation hydrogenation zone contains a hydrogenation catalyst type and providing for concurrent distillation separation of a first catalytic distillation product into said light overhead product and said heavy bottoms product.

4. A method as recited in claim 1, wherein said second catalytic distillation column for receiving said heavy bottoms product and which defines a hydrodesulfurization zone having within said hydrodesulfurization zone at least one catalytic distillation hydrodesulfurization zone with each said at least one catalytic distillation hydrodesulfurization zone containing a hydrodesulfurization catalyst type and providing for concurrent selective hydrodesulfurization of sulfur compounds contained in said heavy bottoms product and distillation separation of a second catalytic distillation product into said overhead product and said bottoms product.

5. A method as recited in claim 1, wherein said heavy bottoms product has a total organic sulfur concentration in the range of from about 300 ppm to about 3,000 ppm.

6. A method as recited in claim 1, wherein said bottoms product has a total organic sulfur concentration in the range of from about 50 ppm to about 500 ppm.

7. A method as recited in claim 1, wherein said first treated heavy cat naphtha stream has a total organic sulfur concentration of less than 10 ppm.

8. A method as recited in claim 1, wherein said second treated heavy cat naphtha stream has a total organic sulfur concentration of less than 10 ppm.

9. A method as recited in claim 1, wherein said light overhead product is a light cracked naphtha comprising C5 and C6 hydrocarbons boiling in the range of from 40° C. to 180° C.; and wherein said first catalytic distillation column further provides a gaseous overhead product stream comprising hydrogen and hydrogen sulfide.

10. A method as recited in claim 2, wherein said Group VIII metal catalyst type comprises: a supported nickel catalyst.

11. A method as recited in claim 3, wherein said hydrogenation catalyst type comprises: an alumina support and upwardly to 1 wt. % palladium, based on the total weight of the hydrogenation catalyst.

12. A method as recited in claim 4, wherein said hydrodesulfurization catalyst type comprises: from 2 to 5 wt. % of either nickel or cobalt and from 5 to 20 wt. % either molybdenum, tungsten or chromium and an alumina support with wt. % based on the total weight of the hydrodesulfurization catalyst.

* * * * *